US012102868B2

(12) United States Patent
James

(10) Patent No.: US 12,102,868 B2
(45) Date of Patent: Oct. 1, 2024

(54) ADJUSTABLE MODIFIED EXERCISE BENCH DEVICE

(71) Applicant: Samuel James, Riverside, CA (US)

(72) Inventor: Samuel James, Riverside, CA (US)

( * ) Notice: Subject to any disclaimer, the term of this patent is extended or adjusted under 35 U.S.C. 154(b) by 233 days.

(21) Appl. No.: 17/867,605

(22) Filed: Jul. 18, 2022

(65) Prior Publication Data

US 2024/0017120 A1 Jan. 18, 2024

(51) Int. Cl.
*A63B 21/00* (2006.01)
*A63B 23/12* (2006.01)

(52) U.S. Cl.
CPC ..... *A63B 21/4029* (2015.10); *A63B 21/4035* (2015.10); *A63B 23/1236* (2013.01); *A63B 2225/09* (2013.01)

(58) Field of Classification Search
CPC ..... A63B 21/4029; A63B 21/4035; A63B 23/1236; A63B 2225/09
See application file for complete search history.

(56) References Cited

U.S. PATENT DOCUMENTS 4,241,915 A 12/1980 Noble
4,884,803 A 12/1989 Miller
5,176,603 A * 1/1993 Hundley ..... A63B 21/4029 482/145
7,060,014 B2 6/2006 Bergman
7,658,702 B1 2/2010 Harms
D812,158 S 3/2018 Campanaro
2008/0045390 A1 2/2008 Harms
2019/0344119 A1 11/2019 Almeda

FOREIGN PATENT DOCUMENTS

CA 2280303 8/1999
CN 111450486 B * 2/2021 ..... A63B 21/4029

* cited by examiner

*Primary Examiner* — Megan Anderson
*Assistant Examiner* — Jacqueline N L Loberiza

(57) ABSTRACT

An adjustable modified exercise bench device for ameliorating the performance of a push-up exercise includes a pad being positioned at an angle relative to the ground. A bar is coupled to a base surface of the pad. A first end of the bar has a protrusion. A foot rest is positioned perpendicular relative to the bar. A center plate provides support proximate to the first end of the bar. Furthermore, a pair of bases protrudes out from the bar. The pair of bases is positioned proximate to the first end of the bar, and each of the bases has an interior. The interior of each of the bases defines a space for a respective one of a pair of handles to be nested within. Each of the handles has a grip is adjustable in positioning relative to the pair of bases.

10 Claims, 4 Drawing Sheets

ADJUSTABLE MODIFIED EXERCISE BENCH DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to exercise bench device and more particularly pertains to a new exercise bench device for ameliorating the performance of a push-up exercise.

(2) Description of Related Art Including Information Disclosed Under 37 CFR 1.97 and 1.98

The prior art relates to exercise bench devices. The prior art includes a variety of exercise bench devices positioned at an angle relative to the ground. Known prior art lacks an exercise bench device having a pair of adjustable handles positioned on a side of the bench device to ameliorate the performance of a push-up exercise.

BRIEF SUMMARY OF THE INVENTION

An embodiment of the disclosure meets the needs presented above by generally comprising a pad is configured for being positioned at an angle relative to the ground. The pad is a hard rubber material having a peripheral surface and a base surface. The peripheral surface is configured for abutting the body of the user. A bar is coupled to the base surface of the pad and is positioned parallel relative to the pad. The bar has a first end and a second end, and the first end of the bar has a protrusion. A foot rest is positioned perpendicular relative to the bar. The foot rest has a base protruding out from the foot rest, and the base has a cavity. The cavity defines a space for nesting the second end of the bar, wherein the second end of the bar is configured for being adjustable in positioning within the cavity the base of the foot rest. A center plate provides support proximate to the first end of the bar. The center plate has a base having a chamber. The chamber defines a space for nesting the protrusion of the bar. The protrusion of the bar is configured for being adjustable in positioning within the chamber of the base of the center plate. Furthermore, a pair of bases protrudes out from the bar. The pair of bases is positioned proximate to the first end of the bar, and each of the bases has an interior. The interior of each of the bases defines a space for a respective one of a pair of handles to be nested within. Each of the handles has a grip being configured for being adjustable in positioning relative to the pair of bases.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
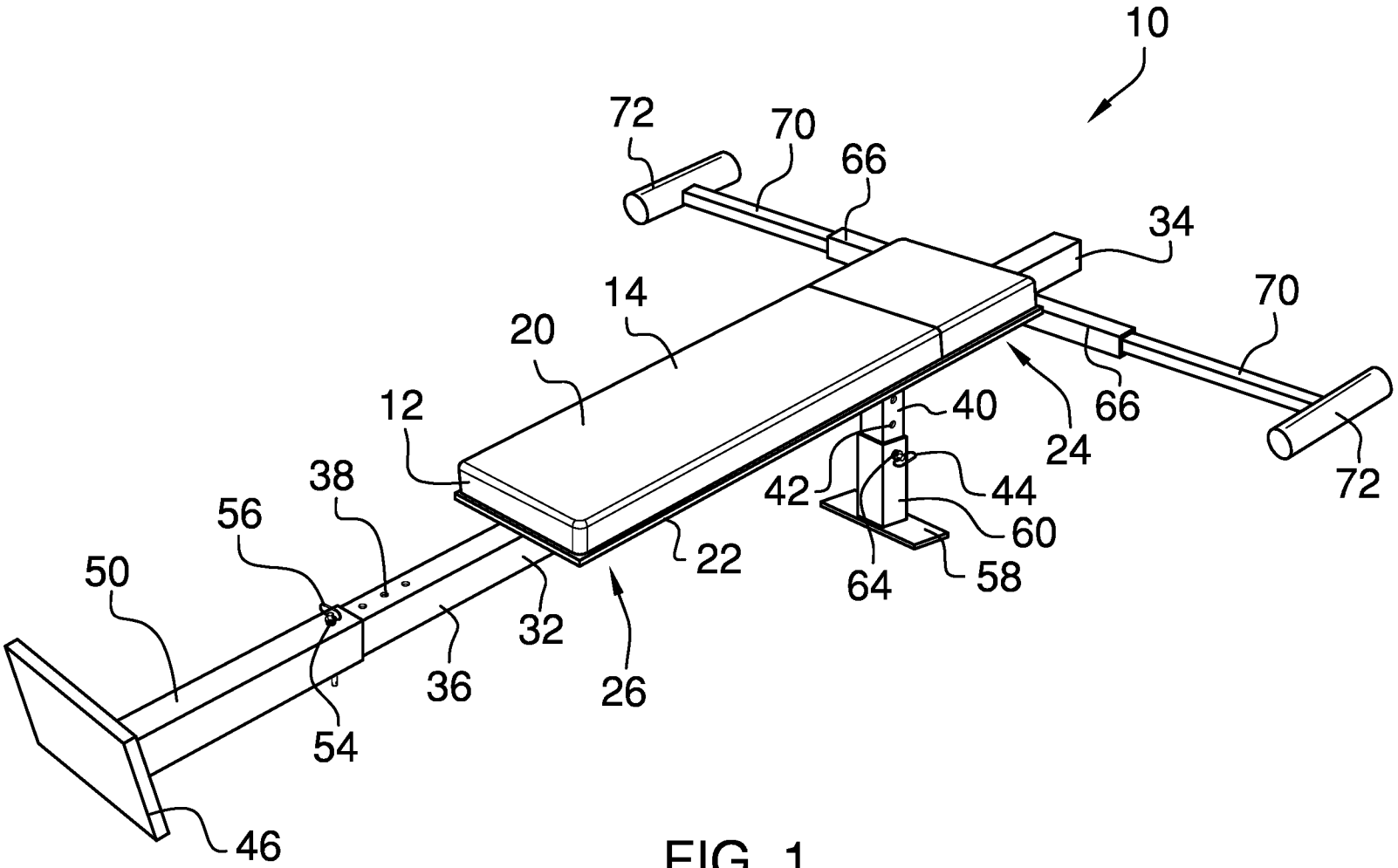
FIG. 1 is an isometric view of an adjustable modified exercise bench device according to an embodiment of the disclosure.
Figure 2:
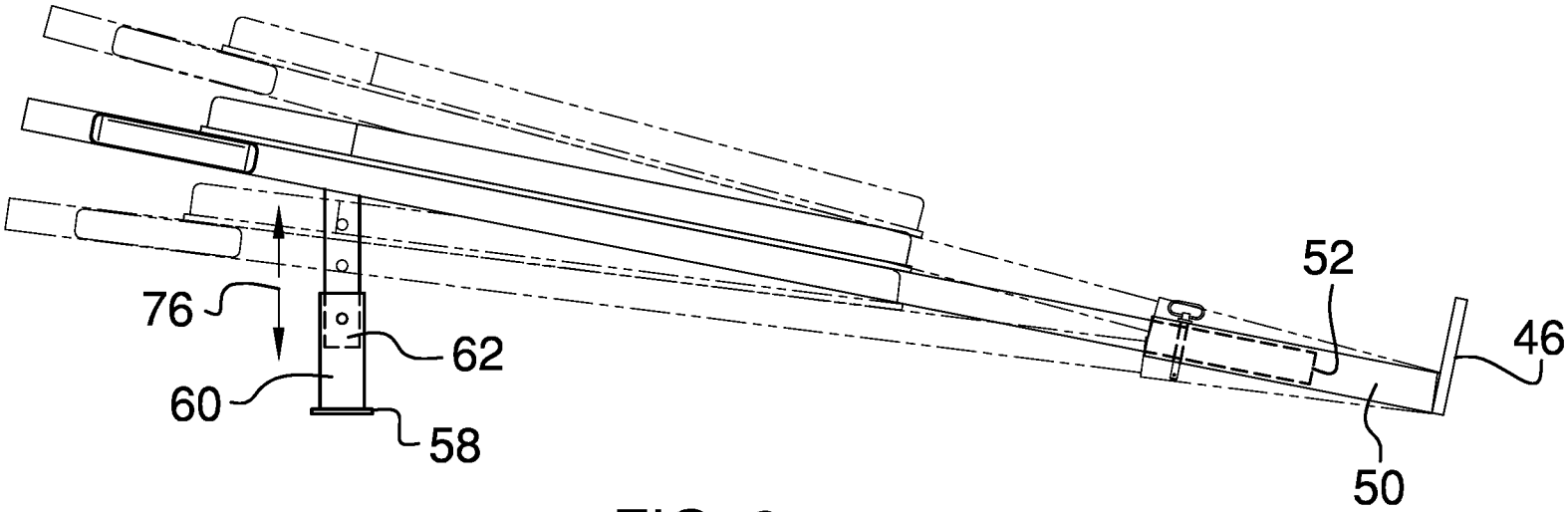
FIG. 2 is a side view of an embodiment of the disclosure.
Figure 3:
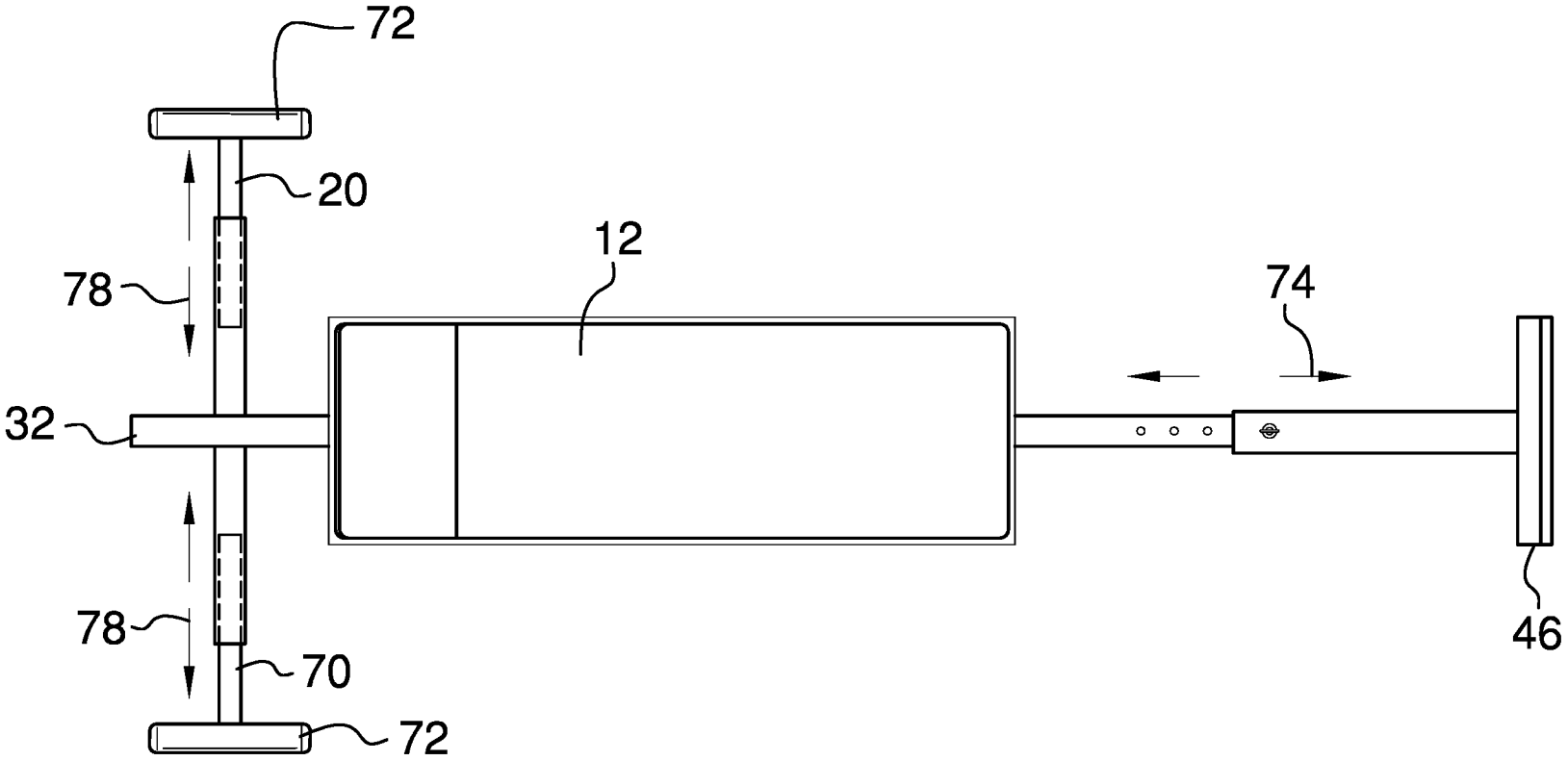
FIG. 3 is a top view of an embodiment of the disclosure.
Figure 4:
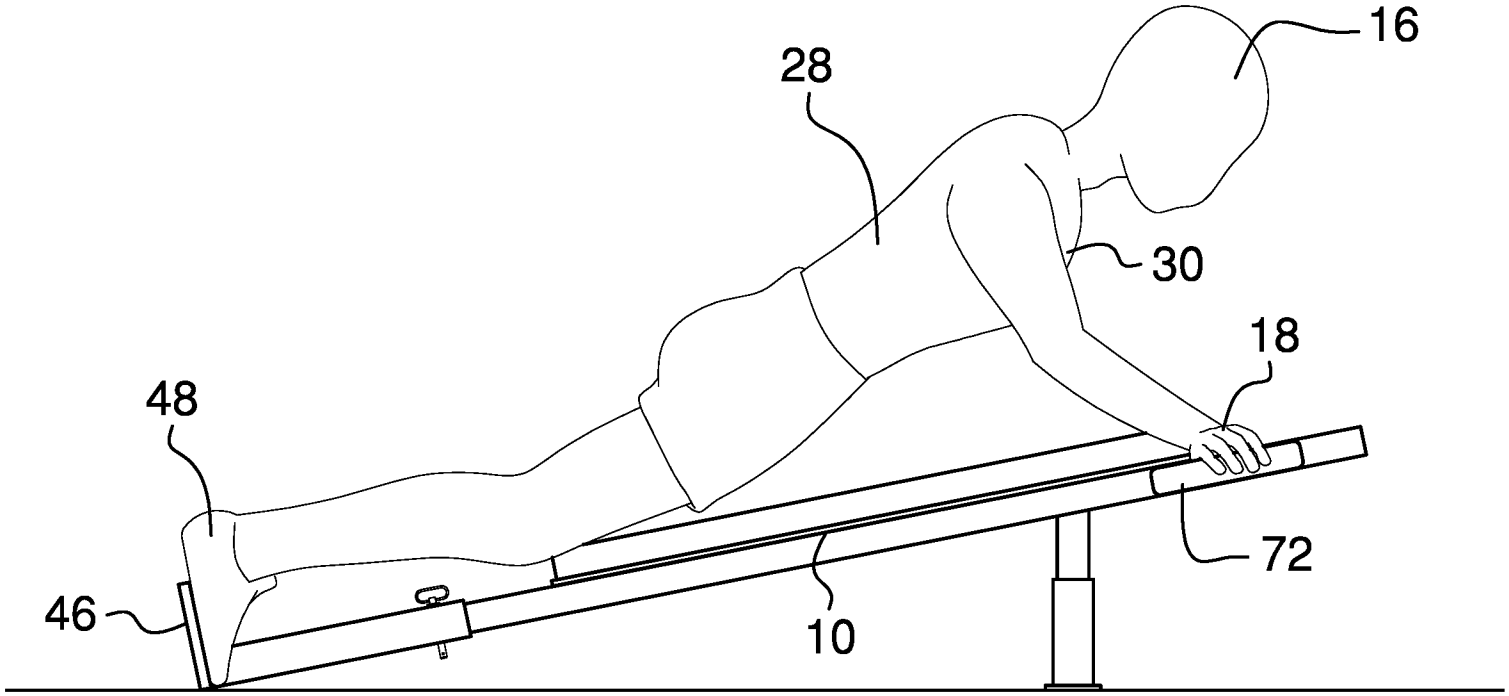
FIG. 4 is an in-use view of an embodiment of the disclosure.

With reference now to the drawings, and in particular to FIGS. 1 through 4 thereof, a new exercise bench device embodying the principles and concepts of an embodiment of the disclosure and generally designated by the reference numeral 10 will be described.

As best illustrated in FIGS. 1 through 4, the adjustable modified exercise bench device 10 generally comprises a pad 12. The pad 12 is configured for being positioned at an angle relative to the ground to enhance the performance of an inclined push-up exercise. The pad 12 is a hard rubber material 14 being configured for providing comfort to a user 16 by compressing a body 28 of the user 16. The pad 12 has a rectangular shape including a peripheral surface 20 and a base surface 22. Additionally, the pad 12 has an upper end 24 and a lower end 26. The peripheral surface 20 is configured for abutting the body 28 of the user 16, and the upper end 24 is configured for positioning against a chest 30 of the user 16.

A bar 32 is coupled to the base surface 22 of the pad 12. Furthermore, the bar 32 is positioned parallel relative to the pad 12. The bar 32 has a first end 34 and a second end 36, wherein the first end 34 of the bar 32 is positioned proximate to the upper end 24 of the pad 12. Alternately, the second end 36 of the bar 32 is positioned proximate to the lower end 26 of the pad 12. The second end 36 of the bar 32 has a plurality of holes 38. The bar 32 is configured for supporting the pad 12. In addition, the first end 34 of the bar 32 has a protrusion 40 extending out from the bar 32. The protrusion 40 is positioned at an angle relative to the bar 32, and the protrusion 40 has a plurality of holes 42. The plurality of holes 42 of the protrusion 40 is used for inserting a pin 44 within.

A foot rest 46 is positioned perpendicular relative to the bar 32. The foot rest 46 is configured for supporting a pair of feet 48 of the user 16. The foot rest 46 has a base 50 protruding out from the foot rest 46 such that the base 50 is positioned perpendicular relative to the foot rest 46. The base 50 has a cavity 52 defining a space for nesting the second end 36 of the bar 32. The base 50 of the foot rest 46 has an aperture 54 being complementary to the plurality of holes 38 of the bar 32. The aperture 54 of the base 50 of the foot rest 46 and the plurality of holes 38 of the bar 32 are configured for fastening by inserting a pin 56 wherein retaining the bar 32 within the cavity 52 of the base 50 of the foot rest 46. The second end 36 of the bar 32 is configured for being adjustable in positioning within the cavity 52 the base 50 of the foot rest 46 wherein adjusting a length 74 of the pad 12 relative to the foot rest 46.

A center plate 58 providing support proximate to the first end 34 of the bar 32 has a base 60. The base 60 of the center plate 58 has a chamber 62 defining a space for nesting the protrusion 40 of the bar 32. The base 60 of the center plate 58 has a hole 64 being complementary to the plurality of holes 42 of the protrusion 40. The hole 64 of the base 60 of the center plate 58 and the plurality of holes 42 of the protrusion 40 are configured for fastening by inserting the pin 44 wherein retaining the protrusion 40 within the chamber 62 of the base 60 of the center plate 58. The protrusion 40 of the bar 32 is configured for being adjustable in positioning within the chamber 62 of the base 60 of the center plate 58 wherein adjusting a height 76 of the pad 12 relative to the center base 58.

A pair of bases 66 protrudes out from the bar 32. The pair of bases 66 is positioned proximate to the first end 34 of the bar 32, and each of the bases 66 is positioned coplanar relative to each other. In addition, each of the bases 66 is position perpendicular relative to the bar 32. Each of the bases 66 has an interior 68 defining a space for a respective one of a pair of handles 70 to be nested within. Each of the handles 70 has a grip 72 being configured for being adjustable in positioning relative to the pair of bases 66 wherein being able to support a range of lengths 78 for the user 16.

In use, the user 16 adjusts the height 76 of the pad 12 relative to the center base 58 for ameliorating the performance of the inclined push-up exercise. The user 16 adjusts the length 74 of the pad 12 relative to the foot rest 46 wherein positioning the upper end 24 of the pad 12 to be positioned abutting the chest 30 of the user 16. The user 16 adjusts the grip 72 of each of the handles 70 within the range of lengths 78 to a desired length prior to performing the inclined push-up exercise. The user 16 faces towards the pad 12 and positions the pair of feet 48 upon the foot rest 46. Each of the hands 18 of the user 16 grasps the grip 72 of a respective one of the pair of handles 70. The user 16 can then perform the inclined push-up exercise by pushing the body 28 of the user 16 outward from the pad 12 using the pair of handles 70 prior to lowering the body 28 of the user 16 towards the pad 12 again.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A modified exercise bench device configured for ameliorating the performance of a push-up exercise, the modified exercise bench device comprising:

a pad being configured for being positioned at an angle relative to a ground, the pad being a hard rubber material, the pad having a peripheral surface and a base surface, the peripheral surface being configured for abutting a body of a user;

a bar being coupled to the base surface of the pad, the bar being positioned parallel relative to the pad, the bar having a first end and a second end, the first end of the bar having a protrusion;

a foot rest being positioned perpendicular relative to the bar, the foot rest having a base protruding out from the foot rest, the base having a cavity, the cavity defining a space for nesting the second end of the bar, the second end of the bar being configured for being adjustable in positioning within the cavity the base of the foot rest;

a center plate providing support proximate to the first end of the bar, the center plate having a base, the base of the center plate having a chamber, the chamber defining a space for nesting the protrusion of the bar, the protrusion of the bar being configured for being adjustable in positioning within the chamber of the base of the center plate; and a pair of bases protruding out from the bar, the pair of bases being positioned proximate to the first end of the bar, each base of the pair of bases having an interior, the interior defining a space for a respective one of a pair of handles to be nested within, each handle of the pair of handles having a grip, the grip being configured for being adjustable in positioning relative to the pair of bases.

2. The modified exercise bench device of claim 1, further comprising the pad having an upper end and a lower end, the upper end being configured for positioning against a chest of the user.

3. The modified exercise bench device of claim 2, further comprising the first end of the bar being positioned proximate to the upper end of the pad, the second end of the bar being positioned proximate to the lower end of the pad.

4. The modified exercise bench device of claim 3, further comprising the second end of the bar having a plurality of holes, the bar being configured for supporting the pad.

5. The modified exercise bench device of claim 4, further comprising the protrusion extending out from the bar, the protrusion being positioned at an angle relative to the bar, the protrusion having a plurality of holes.

6. The modified exercise bench device of claim 5, further comprising the base of the foot rest having an aperture, the aperture of the base being complementary to the plurality of holes of the bar, the plurality of holes of the bar and the aperture of the base being configured for fastening by inserting a pin to retain the bar within the cavity of the base of the foot rest.

7. The modified exercise bench device of claim 6, further comprising the base of the center plate having a hole, the hole of the base of the center plate being complementary to the plurality of holes of the protrusion, the plurality of holes of the protrusion and the hole of the base of the center plate being configured for fastening by inserting a pin to retain the bar within the chamber of the center plate.

8. The modified exercise bench device of claim 1, further comprising the hard rubber material being configured for providing comfort to the user, the pad having a rectangular shape.

9. The modified exercise bench device of claim 1, further comprising the foot rest being configured for supporting a pair of feet of the user.

10. A modified exercise bench device configured for ameliorating the performance of a push-up exercise, the modified exercise bench device comprising:

a pad being configured for being positioned at an angle relative to a ground, the pad being a hard rubber material, the hard rubber material being configured for providing comfort to a user, the pad having a rectangular shape, the pad having a peripheral surface and a base surface, the peripheral surface being configured for abutting the body of the user, the pad having an upper end and a lower end, the upper end being configured for positioning against a chest of the user;

a bar being coupled to the base surface of the pad, the bar being positioned parallel relative to the pad, the bar having a first end and a second end, the first end of the bar being positioned proximate to the upper end of the pad, the second end of the bar being positioned proximate to the lower end of the pad, the second end of the bar having a plurality of holes, the bar being configured for supporting the pad, the first end of the bar having a protrusion, the protrusion extending out from the bar, the protrusion being positioned at an angle relative to the bar, the protrusion having a plurality of holes;

a foot rest being positioned perpendicular relative to the bar, the foot rest being configured for supporting a pair of feet of the user, the foot rest having a base protruding out from the foot rest, the base being positioned perpendicular relative to the foot rest, the base of the foot rest having a cavity, the cavity defining a space for nesting the second end of the bar, the base of the foot rest having an aperture, the aperture of the base being complementary to the plurality of holes of the bar, the plurality of holes of the bar and the aperture of the base being configured for fastening by inserting a pin to retain the bar within the cavity of the base of the foot rest, the second end of the bar being configured for being adjustable in positioning within the cavity the base of the foot rest;

a center plate providing support proximate to the first end of the bar, the center plate having a base, the base of the center plate having a chamber, the chamber defining a space for nesting the protrusion of the bar, the base of the center plate having a hole, the hole of the base of the center plate being complementary to the plurality of holes of the protrusion, the plurality of holes of the protrusion and the hole of the base of the center plate being configured for fastening by inserting a pin to retain the bar within the chamber of the center plate, the protrusion of the bar being configured for being adjustable in positioning within the chamber of the base of the center plate; and a pair of bases protruding out from the bar, the pair of bases being positioned proximate to the first end of the bar, each base of the pair of bases having an interior, the interior defining a space for a respective one of a pair of handles to be nested within, each handle of the pair of handles having a grip, the grip being configured for being adjustable in positioning relative to the pair of bases.

* * * * *